US006102312A

United States Patent [19]

Aberle

[11] Patent Number: 6,102,312

[45] Date of Patent: Aug. 15, 2000

[54] ROTARY HAMMER MILL

[76] Inventor: David H. Aberle, 5916 Braun Way, Arvada, Colo. 80004

[21] Appl. No.: 09/335,429

[22] Filed: Jun. 17, 1999

[51] Int. Cl.[7] ..... B02C 13/04; B02C 21/02

[52] U.S. Cl. ..... 241/101.742; 241/189.1; 241/194; 241/197; 241/291

[58] Field of Search ..... 241/101.742, 189.1, 241/191, 194, 197, 291

[56] References Cited

U.S. PATENT DOCUMENTS

| | | | |
|---|---|---|---|
| 529,874 | 11/1894 | Parker . | |
| 1,281,829 | 10/1918 | Plaisted . | |
| 1,439,754 | 12/1922 | Plaisted | 241/194 |
| 2,045,688 | 6/1936 | Armstrong | 241/194 |
| 2,045,689 | 6/1936 | Armstrong | 241/194 |
| 2,331,597 | 10/1943 | Coles . | |
| 3,455,517 | 7/1969 | Gilbert . | |
| 4,136,833 | 1/1979 | Knight . | |
| 4,650,129 | 3/1987 | Newell et al. . | |
| 4,973,005 | 11/1990 | Haesebrouck et al. . | |
| 5,141,167 | 8/1992 | Stelk . | |
| 5,377,919 | 1/1995 | Rogers et al. . | |
| 5,405,092 | 4/1995 | Jonninen . | |
| 5,484,111 | 1/1996 | Dorscht et al. . | |
| 5,490,637 | 2/1996 | Golesis . | |
| 5,683,042 | 11/1997 | Giovanardi . | |
| 5,794,866 | 8/1998 | Shinn | 241/101.72 |
| 5,842,653 | 12/1998 | Elliott et al. | 241/88.1 |

FOREIGN PATENT DOCUMENTS

| | | |
|---|---|---|
| 2635022 | 2/1990 | France . |
| M18653 | 11/1956 | Germany . |
| 3414543 | 10/1984 | Germany . |
| 681342 | 3/1993 | Switzerland . |
| 1761268 | 9/1992 | U.S.S.R. . |
| 541476 | 11/1941 | United Kingdom . |

*Primary Examiner*—John M. Husar
*Attorney, Agent, or Firm*—Brian D. Smith, P.C.

[57] ABSTRACT

A rotary hammer mill for breaking, cutting and crushing frangible or fracturable solid materials. The hammer is formed by a shaft rotatable about a horizontal, longitudinal axis. A plurality of swinging hammers are aligned along the shaft and each is positioned in a separate vertical plane for partial swinging movement about its own pivot axis parallel to and spaced from the shaft axis. The hammer mill is adapted for mounting on a self-propelled, dirigible vehicle and is capable of breaking, cutting and crushing a wide variety of materials.

16 Claims, 4 Drawing Sheets

ROTARY HAMMER MILL

TECHNICAL FIELD OF THE INVENTION

The present invention relates to rotary hammer mills for breaking, cutting and crushing fracturable solid materials, and more specifically to rotary hammer mills with swinging or pivoted hammers.

BACKGROUND OF THE INVENTION

U.S. Pat. No. 2,331,597, issued Oct. 12, 1943, to G. Coles, for "Disintegrator Hammer" describes a rotary hammer mill with hammers pivotally connected with a rotor. Another hammer mill with hammers pivoted to a rotor about an axis at a radial distance from the axis of the central shaft of the rotor is shown in U.S. Pat. No. 4,973,005, issued Nov. 27, 1990, to F. Haesebrouck et al., for "Hammer-Crusher Rotor."

OBJECTS OF THE INVENTION

The principal object of the present invention is to provide an improved rotary hammer mill capable of rapidly and efficiently breaking, cutting and crushing solid material.

Another object of the present invention is to provide a hammer mill of the foregoing character utilizing large massive hammers capable of breaking and crushing a wide variety of materials of varying compositions, configurations, sizes, and shapes, such as in situ pavement, concrete, bricks, asphalt, and rock, as well as loose debris such as stone rubble, mild steel, re-bar, nails, wire, trees and timber, and other fracturable materials.

Still a further object of the present invention is to provide a rotary hammer mill of the foregoing character which is capable of imparting large impact forces and is resistant to jamming.

Still another object of the present invention is to provide a rotary hammer mill of the foregoing character which can be supported on its own vehicle or removably mounted on an existing vehicle such as a loader, backhoe, tractor, excavator, and the like.

Still a further object of the present invention is to provide a rotary hammer mill of the foregoing character which is useful for a wide variety of uses including land clearing, street and curb crushing, and building or bridge demolition.

SUMMARY OF THE INVENTION

The present invention is embodied in a hammer mill which in its broadest sense comprises a shaft rotatable about an axis and a plurality of swinging hammers aligned along the shaft which are swung about their own pivot axes by the rotation of the shaft. The pivot axes are parallel to and spaced from the shaft axis. In addition, each hammer is positioned in a separate vertical plane for greater than 90 degrees of swinging movement about its pivot axis. Finally, the head of each hammer has a width of at least 45 degrees as measured from the shaft axis when the hammer is fully extended.

A preferred embodiment of the hammer mill is adapted for mounting on a self-propelled, dirigible vehicle and capable of breaking, cutting and crushing fracturable solid materials. The hammer mill is formed by a frame mountable on the vehicle, either permanently or removably, and supports a curved housing mounted on and extending upwardly and away from the frame and having a pair of end panels secured to said housing one at each end thereof. A grate defining a comb is supported on the housing between the end panels and extends along the housing between the end panels. A main shaft is journaled on and extends between the end panels within the housing and above the grate. A drive mechanism operatively connecting a power source to the shaft for rotating the same.

A plurality of hammer assemblies are mounted on the shaft in axial alignment therewith and with each other. Each hammer assembly is formed by a hollow toroidal housing having opposed side panels joined peripherally by an outer arcuate panel and defining an interior toroidal chamber with an opening along a portion of the periphery thereof. A massive hammer is pivotally mounted in each chamber for swinging movement about a pivot axis extending parallel to and spaced from the axis of the shaft. The hammers swing outwardly through the opening under centrifugal forces created by the rotation of the shaft and housing for impact engagement with a fracturable solid as the vehicle traverses the area of the solid.

For shielding the junction between each toroidal housing and preventing particles of material from lodging therein, an arcuate, channel-shaped shield is mounted on the housing and depends therefrom in juxtaposition with the junction between adjoining toroidal housings.

To cushion any impact between the hammer and its housing, a pair of impact cushions is mounted within each toroidal housing, one at each extremity of movement of the hammer.

Hardened wear plates are secured to the impact face of each hammer, and hardened wear plates are likewise secured to the leading edges of the grate.

DESCRIPTION OF THE PREFERRED EMBODIMENT

Figure 1:
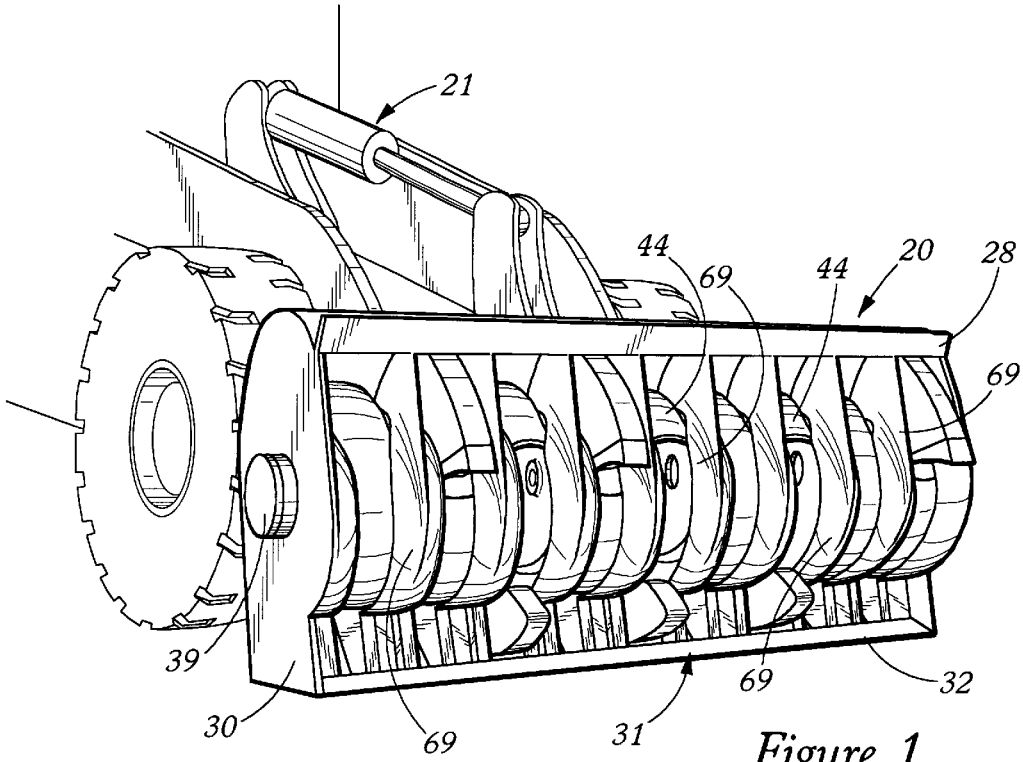
FIG. 1 is a right front perspective view of a rotary hammer mill embodying the present invention mounted on a tractor with an appropriate hitch.

The present invention is embodied in a rotary hammer mill 20 supported on a self-propelled, wheeled or tracked vehicle 21 such as a tractor, backhoe, loader or the like (FIG. 1). The vehicle 21 may be a dedicated vehicle with the hammer mill permanently mounted thereon or another general utility type vehicle such as a tractor with an appropriate hitch. In either case, the vehicle and mounting includes a power source (not shown) such as a power takeoff or an independent electric, hydraulic, or other motor for driving the mill 20.

Figure 2:
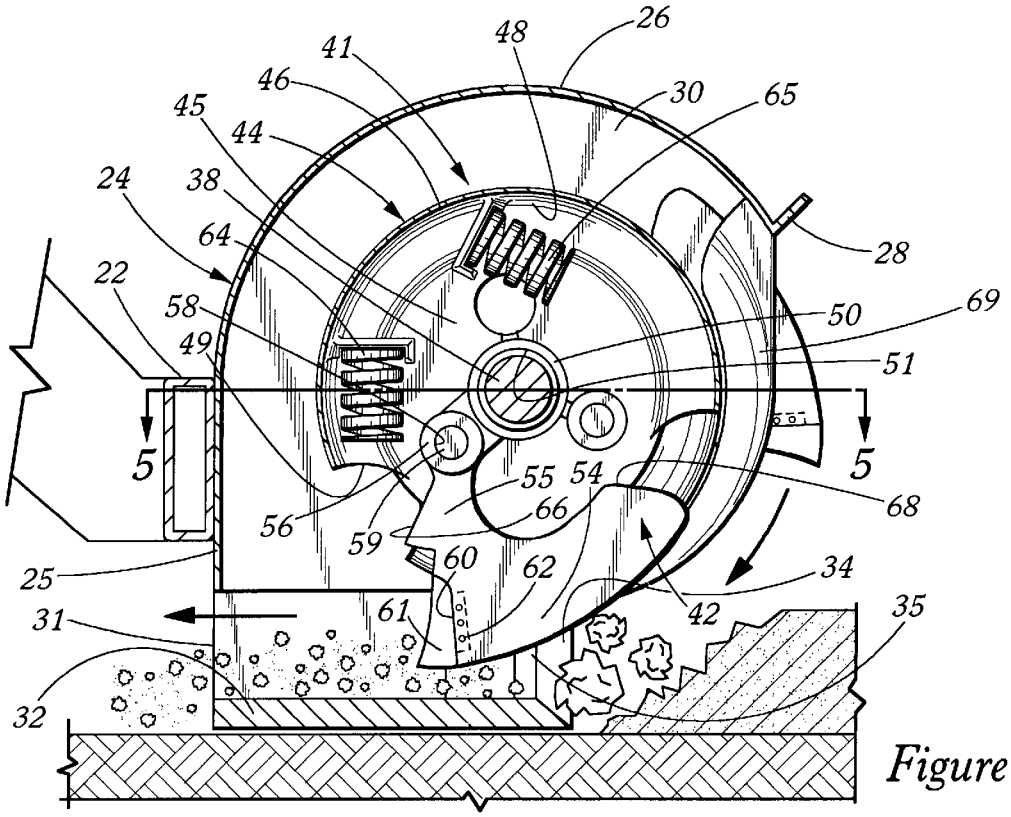
FIG. 2 is an enlarged end view of the hammer mill shown in FIG. 1 with the end plate removed and parts broken away for clarity, and showing the hammer mill with the hammer breaking and crushing in situ concrete or pavement.
Figure 3:
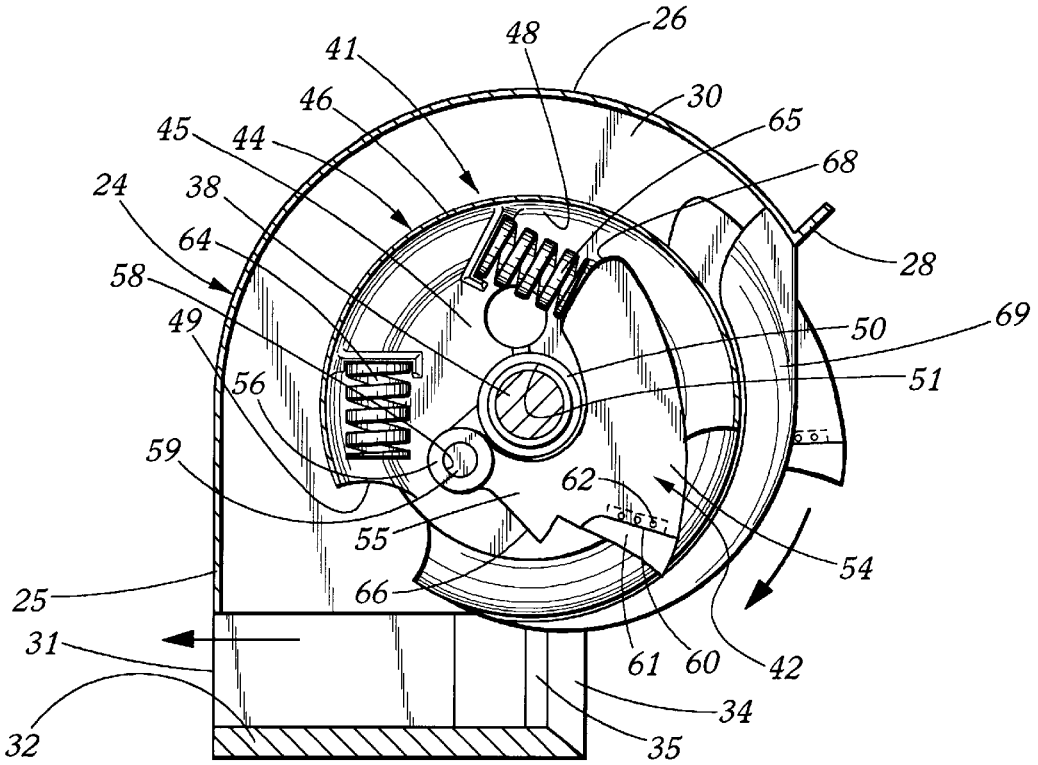
FIG. 3 is an enlarged end view similar to FIG. 2 but with the hammer retracted.
Figure 4:
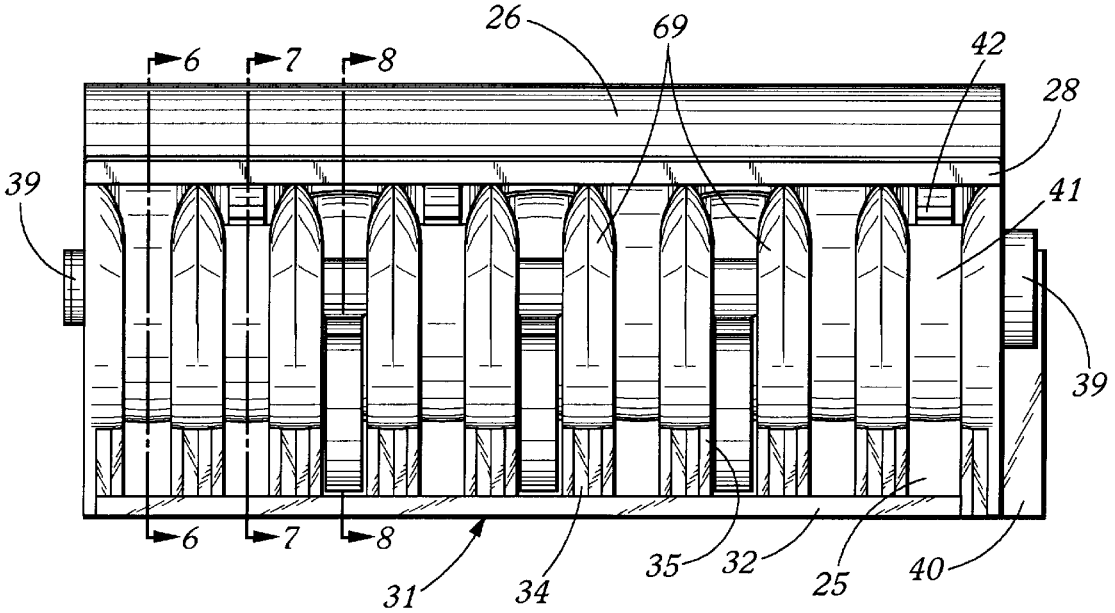
FIG. 4 is a front elevation view of the hammer mill shown in FIG. 1.

The hammer mill 20 is formed by a frame 22 having appropriate fittings (not shown) by which the frame 22 is mounted on a vehicle 21 (FIG. 2). The frame 22 in turn supports an upwardly extending arcuate housing 24 having a generally vertical back panel 25 secured to the frame 22 along a lower edge and extending upwardly into an arcuate or curved portion of defining a curved top wall 26 terminating at its outer edge in an outwardly and upwardly extending elongated rib or flange 28. The housing 24 is enclosed at each end by a side panel or plate 30 secured thereto as by welding (FIGS. 5–8).

For passing comminuted particles, as shown in FIG. 2, the housing is provided at its lower portion with a grate or comb 31 formed by an elongated base plate 32 with upwardly extending vertical teeth 34. The grate or comb 31 is secured to the housing 24 and end panels and extends generally parallel to the frame. Hardened wear inserts 35 are provided along the exposed front edge of each upwardly extending tooth or rib 34 of the grate 31.

Figure 5:
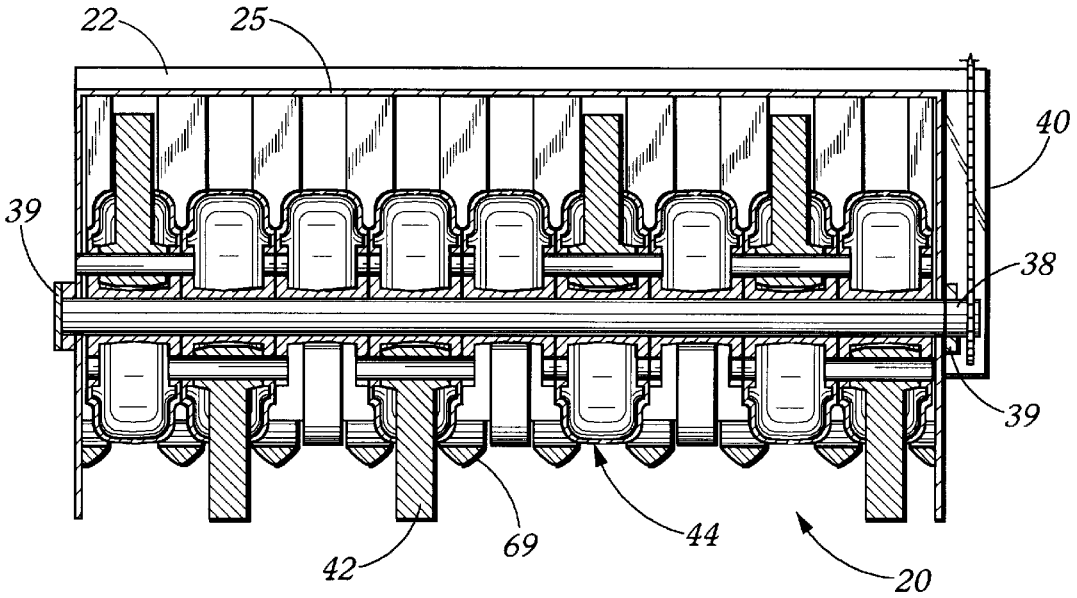
FIG. 5 is a section view taken substantially in the plane of line 5—5 on FIG. 2.

The housing 24 supports and journals a main drive shaft 38 extending between the end panels 30 generally parallel to the housing 24 and frame 22 and rotating about a generally horizontal axis (FIG. 5). To this end, appropriate bearings 39 mounted on the side plates or end panels 30 journal and support the shaft 38. The shaft is driven by a chain and sprocket or belt and pulley drive mechanism 40 operatively connecting the shaft to the power source. The drive mechanism and power source rotates the shaft in the bearings about its axis of rotation.

Figure 6:
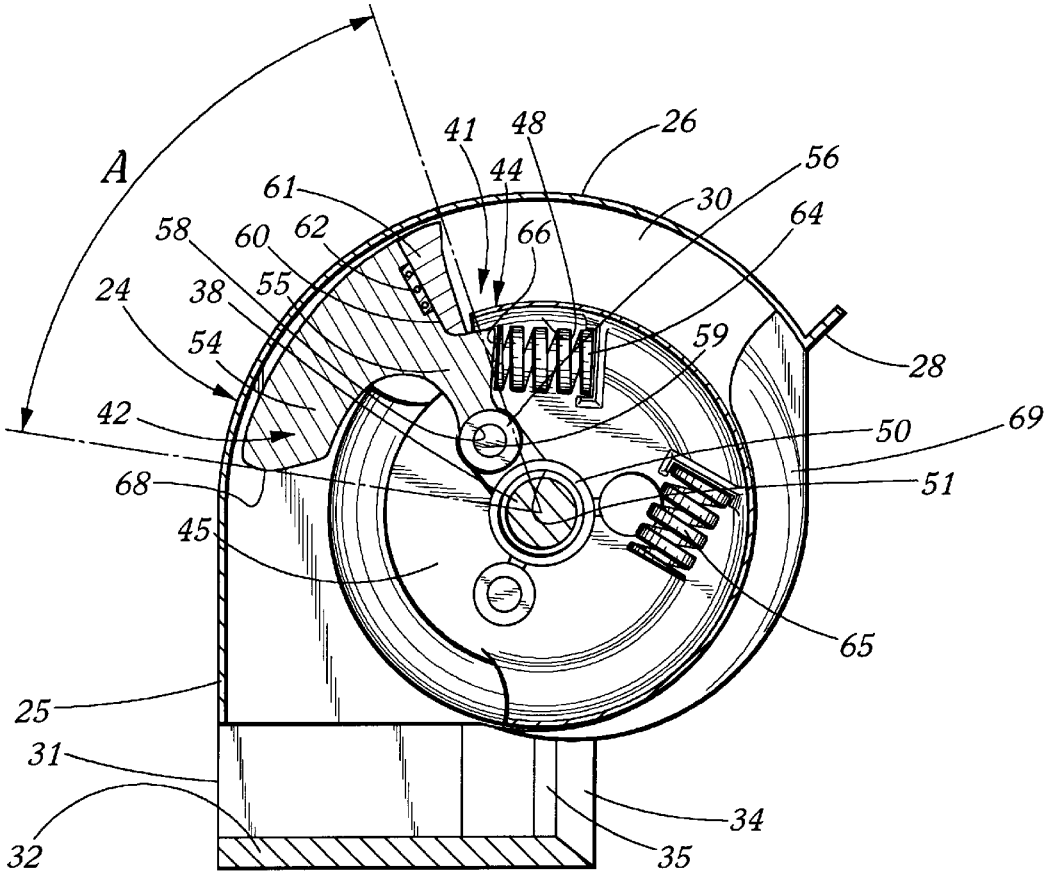
FIG. 6 is a section view taken substantially in the plane of line 6—6 on FIG. 4.
Figure 7:
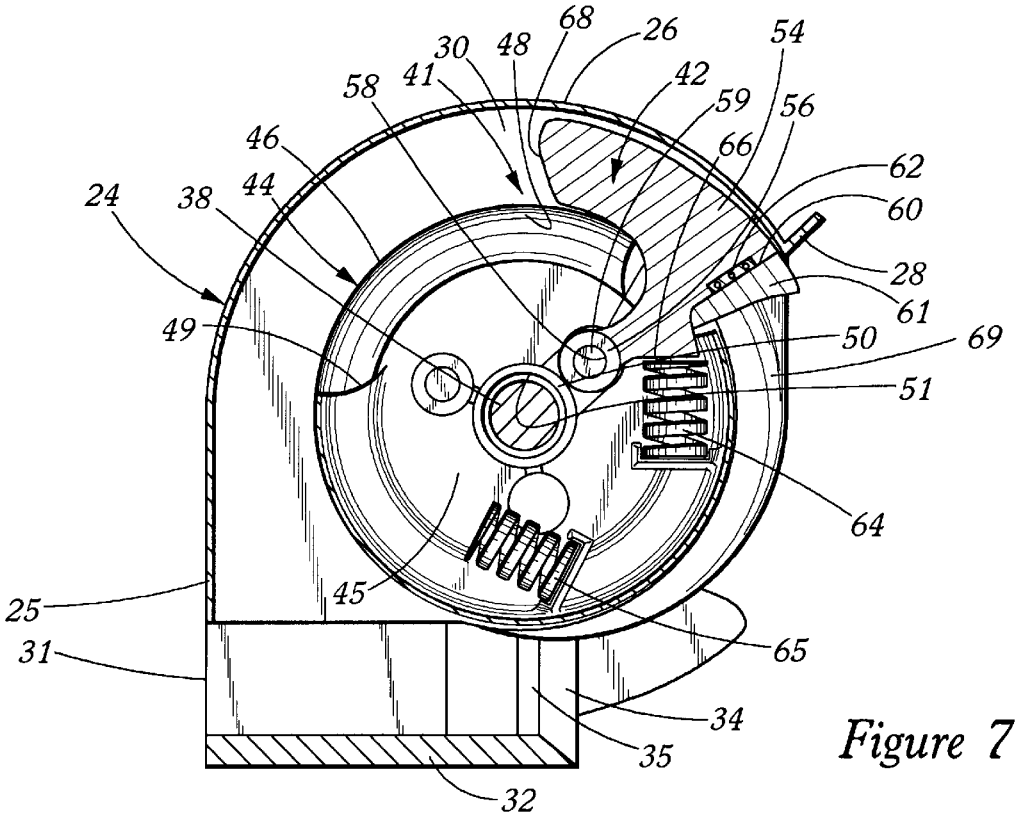
FIG. 7 is a section view taken substantially in the plane of line 7—7 on FIG. 4.
Figure 8:
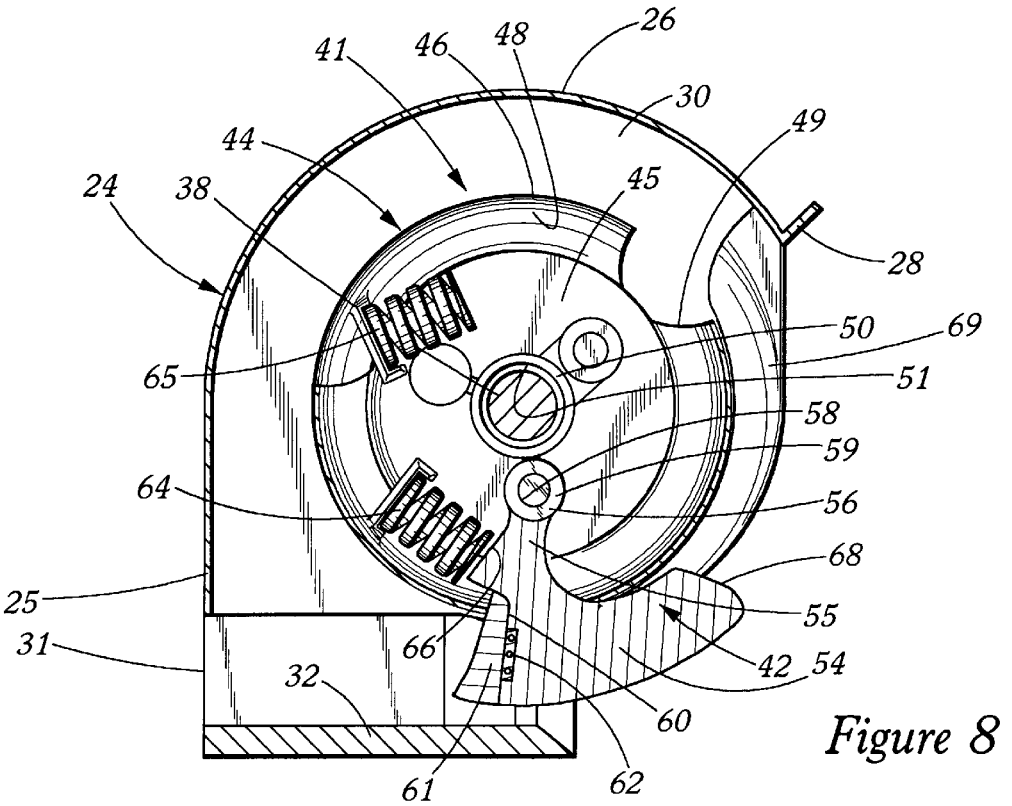
FIG. 8 is a section view taken substantially in the plane of line 8—8 on FIG. 4.

To effect the breaking, cutting, crushing and comminution of solid materials, a plurality of hammer mechanisms or assemblies 41 are mounted along the shaft in axial alignment therewith (FIGS. 6–8). Each hammer mechanism 41 is formed by a single massive hammer 42 swingably or pivotally mounted in a rigid, toroidal housing or fly-housing 44 having opposed side panels 45 joined peripherally by an outer arcuate panel 46 and defining an interior toroidal chamber 48 in which the hammer 42 is swingably mounted. An opening 49 along a portion of the periphery of the toroidal housing 44 allows the hammer 42 to swing outwardly from the housing 44 under centrifugal forces into impact engagement with a surface or material to be broken or crushed (FIGS. 5–8).

For mounting on and engagement with the drive shaft 38, each toroidal housing 44 is formed with a central axial sleeve 50 extending between the housing side panels 45 and defining a bore 51 for receiving the shaft 38 (FIGS. 5–8). The hammer housing 44 is tightly secured to the shaft for rotation therewith in any suitable manner as by a key or keys, a spline, or other suitable mechanical connection (not shown).

The massive impact hammer 42 is formed by an enlarged, elongated, curved or arcuate hammer head 54 having an arm or handle 55 extending generally perpendicularly therefrom adjacent one end thereof (FIGS. 2, 6–8). At its outer end, the hammer arm 55 defines a sleeve 56 having a bore 58 receiving a pivot shaft 59 mounted within the toroidal chamber 48 and having an axis parallel to but spaced from the axis of the main drive shaft 38.

The hammer head 54 defines an impact face 60 for impact engagement with materials to be broken, cut or crushed. To increase the wearability of the hammer head 54, a hardened wear insert 61 is attached to the hammer face 60 by appropriate machine screws 62 or other suitable fasteners (FIG. 2).

Because the hammer 42 is a massive body, it develops substantial inertia during use, both from centrifugal forces extending the hammer from the housing, and impact forces tending to force the hammer 42 to retract into the housing 44. In order to cushion the impact between the heavy hammer 42 and the hammer housing 44 at the extremities of movement of the hammer, impact cushions or cushioning springs 64, 65 or equivalent cushioning or dampening devices are mounted in the toroidal chamber 48 at each extremity of swinging movement of the hammer 42. These cushioning springs 64, 65 engage contact faces 66, 68 on the hammer when the hammer is fully extended from or fully retracted into the hammer housing 44 under the influence of inertia induced forces imparted thereto by centrifugal forces as the shaft 38 rotates or by impact forces as the hammers 42 engage materials to be broken, cut or crushed (FIGS. 2, 6–8).

As the shaft 38 rotates, the hammers 42 swing outwardly under the influence of centrifugal forces through the peripheral opening 49 in the toroidal hammer housing 44. When the hammers 42 strike a fracturable solid, the solid is crushed, cut or broken into particles small enough to pass through the grate or comb 31. If the initial impact does not break or cut the material into sufficiently small particles, the hammer 42 retracts until it passes the particles and, by further impact as the hammer continues to rotate, the particles are crushed into sizes which will pass through the teeth 34 of the grate 31 (FIG. 2).

The hammer 42 with its hardened face inserts 61 is capable of breaking solid materials such as pavement, concrete, bricks and stone, and the like, or of breaking and comminuting debris lying on the ground in the path of the hammer mill 20 as it traverses the area of the material or debris.

Because a plurality of hammer assemblies 41 are aligned axially along the drive shaft 38, it is important that the hammers 42 be arranged in a balanced relationship to prevent damaging vibrations as a result of the rotation thereof. Accordingly, the hammers 42 are spaced at uniform angular relationships with respect to each other, divided equally between any number for balance. For example, with three hammers, they are spaced angularly from each other about 120 degrees. Because of the mass of each of the individual hammers 42, only a single hammer 42 is mounted in any given vertical plane. This allows each hammer 42 to move through an adequate range of swinging movement with respect to the drive shaft 38. It is important that the hammers be capable of retraction into the toroidal housing so that the hammers can by-pass large, unbroken chunks of material.

As will be appreciated from a review of the drawings, each hammer of the illustrated embodiment swings about 135 degrees about its pivot axis. To achieve satisfactory results in accordance with the present invention, each hammer should swing more than 90 degrees about its pivot axis and preferably between about 105 and 170 degrees. Optimum results are believed to be attainable if the hammer is permitted to swing between about 120 and 150 degrees about its pivot axis.

In order to prevent debris from collecting and jamming between the various hammer assemblies 41, arcuate, channel-shaped shields 69 are positioned in front of the junction between each hammer assembly or mechanism 41 (FIGS. 2–8). These shields 69 are secured to the upper forward edge of the main arcuate or curved housing top wall 26 and extend downwardly and convex outwardly around the hammer assemblies 41 in juxtaposition with the junction of adjacent toroidal housings. The shields 69 are generally arcuate in exterior configuration and channel-shaped in cross-section to provide for efficient shielding protection of the area between adjacent hammer mechanisms 41 to prevent jamming of material particles therebetween.

The hammers themselves are large and massive in size and weight in relation to the hammer mill so as to create sufficient impact force to break, cut and/or crush the selected materials. As shown in FIG. 6, the hammer's head has a width of about 63 degrees as shown by angle A which is measured from the shaft's axis when the hammer is fully extended. The hammer head should have a width of at least 45 degrees preferably between about 50 and 80 degrees to provide the type of breaking cutting and/or crushing intended by the present invention. The hammers will cut metals such as mild steel and re-bar, and a wide variety of other materials.

While a certain illustrative embodiment of the present invention has been shown in the drawings and described above in detail, it should be understood that there is no intention to limit the invention to the specific form and embodiment disclosed. On the contrary, the intention is to cover all modifications, alternative constructions, equivalents and uses falling within the spirit and scope of the invention as expressed in the appended claims.

I claim:

1. A rotary hammer mill comprising:

a shaft rotatable about an axis; and a plurality of swinging hammers aligned along said shaft which are swung about their own pivot axes by the rotation of said shaft, said pivot axes being parallel to and spaced from said shaft axis, each said hammer having a head and being positioned in a separate vertical plane for greater than 90 degrees of swinging movement about its said pivot axis, each said hammer head having a width of at least 45 degrees as measured from said shaft axis when said hammer is fully extended.

2. A rotary hammer mill as claimed in claim 1 wherein each said swinging hammer swings between about 105 and 170 degrees about its pivot axis.

3. A rotary hammer mill as claimed in claim 2 further comprising impact cushion means for cushioning engagement with the hammer pivotally mounted therein at the extremities of swinging movement thereof.

4. A rotary hammer mill as claimed in claim 1 wherein each said swinging hammer swings between about 120 and 150 degrees about its pivot axis.

5. A rotary hammer mill as claimed in claim 1 wherein each said hammer head has a width of between about 50 and 80 degrees as measured from said shaft axis when said hammer is fully extended.

6. A rotary hammer mill as claimed in claim 1 further comprising comb means for passing comminuted particles.

7. A rotary hammer mill as claimed in claim 1 further comprising a frame for mounting said mill on a vehicle for propelling said mill.

8. A rotary hammer mill comprising, in combination, a frame; a housing supported on said frame including a rear panel, a top panel, and end panels; a comb defining grate mounted on said housing and extending between said end panels at the lower portion of said housing; a horizontal drive shaft journaled on and extending between said end panels for rotation about a longitudinal axis; a plurality of hammer assemblies mounted in axial alignment on said shaft for rotation therewith; each hammer assembly comprising a hollow toroidal housing having spaced parallel circular side walls joined by a curved outer peripheral wall, a portion of said outer wall defining an opening; a sleeve extending between said side walls and defining a central bore through which said drive shaft extends, a hammer having an arcuate hammer head and an arm extending therefrom and defining a pivot sleeve and bore on the free end thereof; a pivot shaft mounted in said toroidal housing and having an axis spacedly parallel to the axis of rotation of said main shaft for receiving said pivot sleeve and swingably mounting said hammer with said hammer head extendable outwardly through said opening under centrifugal forces imparted thereto by rotation of said shaft for impact engagement with a solid.

9. A rotary hammer mill as claimed in claim 8 wherein said hammer with said hammer head is fully retractable inwardly through said opening.

10. A rotary hammer mill as defined in claim 8 wherein each said hammer defines a hammer face, and further comprising a hardened insert secured to said face and adapted for impact engagement with a solid.

11. A rotary hammer mill as defined in claim 8 further comprising:

a plurality of shields secured to and depending from said top panel of said housing, each said shield being positioned in juxtaposition to a junction between adjacent toroidal housings.

12. A rotary hammer mill as defined in claim 8 wherein said shields are longitudinally arcuate and channel shaped in cross-section.

13. A rotary hammer mill as defined in claim 8 further comprising:

impact cushions mounted in each toroidal housing for cushioning engagement with the hammer pivotally mounted therein at the extremities of swinging movement thereof.

14. A rotary hammer mill as defined in claim 13 wherein said impact cushions are coil springs.

15. A rotary hammer mill as defined in claim 8 further comprising:

wear inserts secured to the leading comb edges of said grate.

16. A hammer mill adapted for mounting on a self-propelled vehicle, said hammer mill comprising:

a frame mountable on said vehicle;

a power source;

a curved housing mounted on and extending upwardly and away from said frame;

a pair of end panels secured to said housing one at each end thereof;

a grate supported on said housing and said end panels and extending along said housing between said end panels;

a main shaft journaled on and extending between said end panels within said housing and above said grate;

a drive mechanism operatively connecting said power source to said shaft for rotating the same;

a plurality of hammer assemblies mounted on said shaft in axial alignment therewith and with each other; each said hammer assembly comprising:

a hollow toroidal housing having opposed side panels joined peripherally by an outer arcuate panel and defining an interior toroidal chamber and an opening along a portion of the periphery thereof; and a hammer pivotally mounted in each said chamber for swinging movement about a pivot axis extending parallel to and spaced from the axis of said shaft; each said hammer swinging outwardly through said opening under centrifugal forces created by the rotation of said shaft and housing for impact engagement with a fracturable solid as said vehicle traverses the area of said solid.

* * * * *